US009325059B2

(12) United States Patent
Wong et al.

(10) Patent No.: US 9,325,059 B2
(45) **Date of Patent: *Apr. 26, 2016**

(54) COMMUNICATION DEVICE AND ANTENNA STRUCTURE THEREOF

(75) Inventors: Kin-Lu Wong, New Taipei (TW); Po-Wei Lin, New Taipei (TW)

(73) Assignee: ACER INCORPORATED, Xizhi Dist., New Taipei (TW)

( * ) Notice: Subject to any disclaimer, the term of this patent is extended or adjusted under 35 U.S.C. 154(b) by 167 days.

This patent is subject to a terminal disclaimer.

(21) Appl. No.: 13/409,128

(22) Filed: Mar. 1, 2012

(65) Prior Publication Data

US 2013/0099979 A1 Apr. 25, 2013

(30) Foreign Application Priority Data

Oct. 20, 2011 (TW) ..... 100138154 A

(51) Int. Cl.

| | |
|---|---|
| ***H01Q 1/38*** | (2006.01) |
| ***H01Q 1/24*** | (2006.01) |
| ***H01Q 9/42*** | (2006.01) |
| ***H01Q 13/10*** | (2006.01) |
| ***H01Q 5/40*** | (2015.01) |

(52) U.S. Cl.

CPC ..... *H01Q 1/38* (2013.01); *H01Q 1/243* (2013.01); *H01Q 5/40* (2015.01); *H01Q 9/42* (2013.01); *H01Q 13/10* (2013.01)

(58) Field of Classification Search

USPC ..... 343/700 MS, 702, 767, 833, 834, 846

See application file for complete search history.

(56) References Cited

U.S. PATENT DOCUMENTS

| | | | | |
|---|---|---|---|---|
| 5,835,063 | A | 11/1998 | Brachat | |
| 8,599,084 | B2 * | 12/2013 | Wong et al. | 343/749 |
| 2010/0188294 | A1 * | 7/2010 | Chung et al. | 343/700 MS |
| 2011/0181480 | A1 | 7/2011 | Hsieh | |
| 2011/0193754 | A1 * | 8/2011 | Schlub et al. | 343/702 |
| 2011/0193758 | A1 * | 8/2011 | Liu et al. | 343/767 |

FOREIGN PATENT DOCUMENTS

CN 2819498 Y 9/2006

(Continued)

OTHER PUBLICATIONS

Kin-Lu Wong et al., "Simple Printed Monopole Slot Antenna for WWAN Mobile Handset", 2011 IEEE International Workshop on Antenna Technology (iWAT), p. 186-189, Mar. 2011.

*Primary Examiner* — Graham Smith

(74) *Attorney, Agent, or Firm* — Winston Hsu; Scott Margo

(57) ABSTRACT

A communication device has an antenna structure including a substrate, a ground element, an open slot and a radiating metal portion. The ground element is disposed on a first surface of the substrate. The open slot is formed on the ground element and substantially parallel with an edge of the ground element, wherein the open slot at least generates a first resonant mode, and a distance between the open slot and the edge of the ground element is shorter than 0.05 wavelength of a center frequency of the first resonant mode. The radiating metal portion is disposed on a second surface of the substrate, wherein the open slot at least partially covers the radiating metal portion, the radiating metal portion at least generates a second resonant mode, and a feed point of the radiating metal portion is electrically coupled to a signal source on the substrate.

9 Claims, 6 Drawing Sheets

(56) References Cited

FOREIGN PATENT DOCUMENTS

| | | | |
|---|---|---|---|
| EP | 0 714 151 | A1 | 5/1996 |
| EP | 2 445 053 | A1 | 4/2012 |
| TW | 201029265 | A1 | 8/2010 |
| WO | 2010010529 | A2 | 1/2010 |

* cited by examiner

COMMUNICATION DEVICE AND ANTENNA STRUCTURE THEREOF

BACKGROUND OF THE INVENTION

1. Field of the Invention

The present invention relates to a communication device and an antenna structure thereof, and more particularly, to a communication device having a monopole slot antenna and a monopole strip antenna integrated therein, where the operating bandwidth of the communication device covers at least 824-960 MHz and 1710-2170 MHz bands.

2. Description of the Prior Art

With the advance of mobile technology, a mobile device needs to be lighter in weight and more compact in appearance. Meanwhile, the ever-evolving communication specification requires wider operating bandwidth as well. Regarding conventional antenna design, in order to reduce the size of an antenna while achieving wideband operation, a clearance space is generally disposed on the top or at the bottom of a communication device, such that the overall Q value (Quality factor) of the antenna drops and the operating bandwidth is increased to cover multiband operations. For example, U.S. Pat. No. 7,932,865 B2, entitled "Coplanar coupled-fed multiband antenna for the mobile device", discloses a multiband built-in antenna design. However, this method cannot utilize the clearance region to further increase operating bandwidth to cover more operating frequency bands.

Therefore, there is a need to provide a communication device, having two wideband operating bands that, for example, cover at least about 824-960 MHz and 1710-2170 MHz bands for the penta-band WWAN (wireless wide area network) operation, and in addition, the antenna therein closely integrates with nearby electronic elements in the communication device.

SUMMARY OF THE INVENTION

One of the objectives of the present invention is to provide a communication device having a monopole slot antenna and a monopole strip antenna integrated therein to cover the penta-band WWAN operation and closely integrate with nearby electronic elements therein.

In order to solve the above-mentioned problem, the present invention discloses an exemplary communication device including a substrate, a ground element, an open slot and a radiating metal portion. The ground element is disposed on a first surface of the substrate. The open slot is formed on the ground element and substantially parallel with an edge of the ground element, wherein the open slot at least generates a first resonant mode, and a distance between the open slot and the edge of the ground element is shorter than 0.05 wavelength of a center frequency of the first resonant mode. The radiating metal portion is disposed on a second surface of the substrate, wherein the open slot at least partially covers the radiating metal portion, the radiating metal portion at least generates a second resonant mode, and a feed point of the radiating metal portion is electrically coupled to a signal source on the substrate.

In order to solve the above-mentioned problem, the present invention discloses an exemplary antenna structure including a substrate, a ground element, an open slot and a radiating metal portion. The ground element is disposed on a first surface of the substrate. The open slot is formed on the ground element and substantially parallel with an edge of the ground element, wherein the open slot at least generates a first resonant mode, and a distance between the open slot and the edge of the ground element is shorter than 0.05 wavelength of a center frequency of the first resonant mode. The radiating metal portion is disposed on a second surface of the substrate, wherein the open slot at least partially covers the radiating metal portion, the radiating metal portion at least generates a second resonant mode, and a feed point of the radiating metal portion is electrically coupled to a signal source on the substrate.

In the communication device of the present invention, the open slot is substantially rectangle-shaped, and generates the first resonant mode in the first operating band of the communication device. Meanwhile, since the open slot at least partially covers the radiating metal portion, the open slot may be used as a clearance region for the radiating metal portion, such that the radiating metal portion may be a monopole strip antenna, generating the second resonant mode in the second operating band of the communication device. In addition, the radiating metal portion may also be used as the feed structure of the open slot to effectively excite the open slot. In the communication device of the present invention, the generated first operating band may cover at least about 824-960 MHz band, and the second operating band may cover at least about 1710-2170 MHz band, such that the communication device may cover the penta-band WWAN operation.

Besides, the edge of the ground element may also be electrically coupled to a metal conductor. The metal conductor has a width, and is substantially perpendicular to the ground element. The width of the metal conductor is not larger than the thickness of the communication device. The metal conductor may excite the ground element, which increases the bandwidth of the first resonant mode, covers more operating bands, and may be part of the housing of the communication device.

In one embodiment, the metal conductor integrates with an electronic element, and part of the electronic element is electrically coupled to the ground element.

These and other objectives of the present invention will no doubt become obvious to those of ordinary skill in the art after reading the following detailed description of the preferred embodiment that is illustrated in the various figures and drawings.

DETAILED DESCRIPTION

Further details, features and advantages of the invention will be described, by way of example only, with reference to the drawings.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is electrically connected to another device, that connection may be through a direct electrical connection, or through an indirect electrical connection via other devices and connections.

Figure 1:
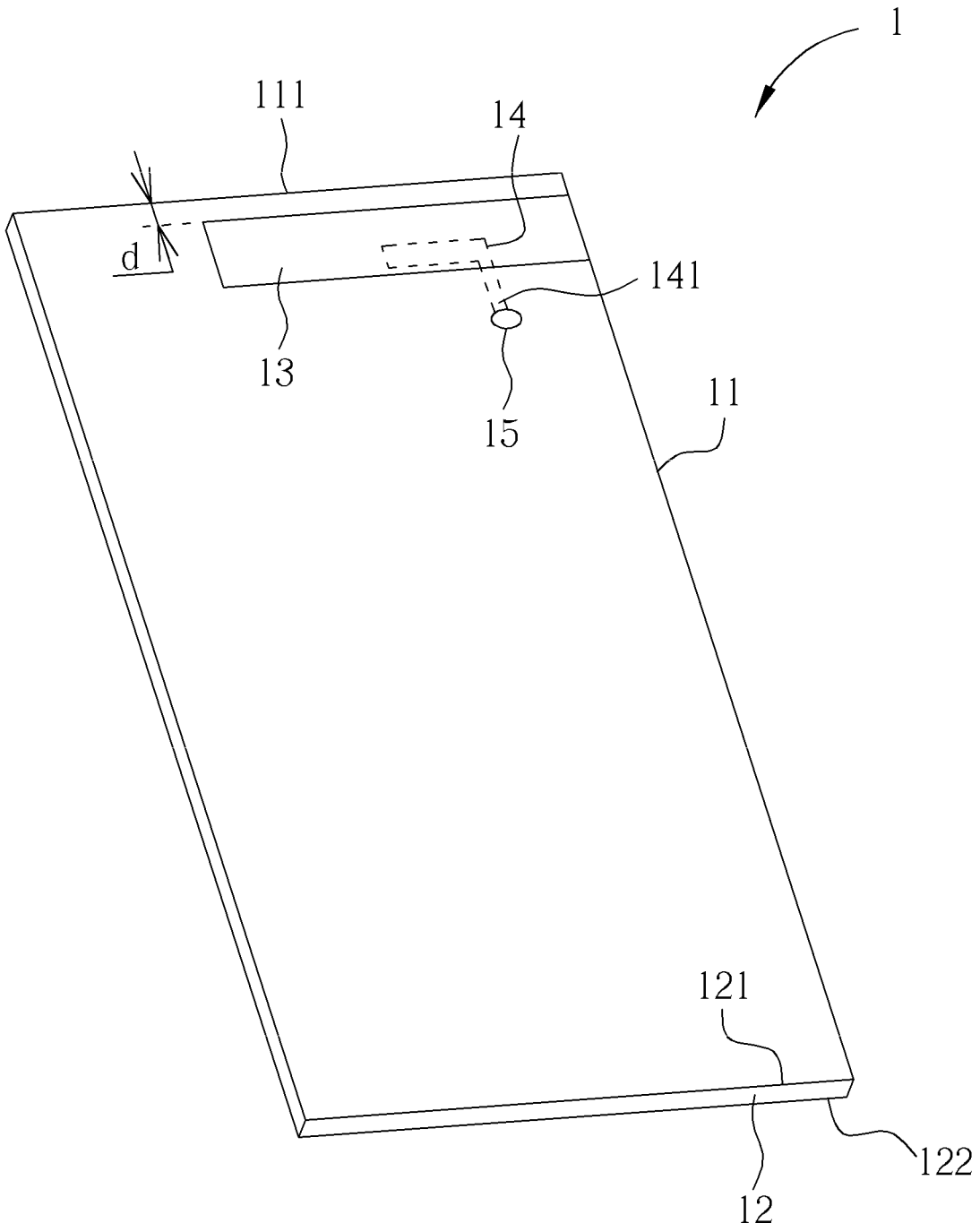
FIG. 1 is a schematic diagram illustrating a communication device and its antenna structure according to a first embodiment of the present invention.

Please refer to FIG. 1, which is a schematic diagram illustrating a communication device 1 and its antenna structure according to a first embodiment of the present invention. The communication device 1 includes a ground element 11, a substrate 12, an open slot 13 and a radiating metal portion 14. The ground element 11 is disposed on a first surface 121 of the substrate 12. The open slot 13 is formed on the ground element 11, and the open slot 13 is substantially parallel with an edge 111 of the ground element 11. The open slot 13 generates at least a first resonant mode, and a distance d between the open slot 13 and the edge 111 of the ground element 11 is shorter than 0.05 wavelength (λ) of a center frequency of the first resonant mode (i.e., $d<0.05\lambda$), such that the open slot 13 is sufficiently close to the edge 111 of the ground element 11 to therefore have practical application value. In addition, the radiating metal portion 14 is disposed on a second surface 122 of the substrate 12, and the open slot 13 at least partially covers the radiating metal portion 14. The radiating metal portion 14 at least generates a second resonant mode and increases operating bandwidth of the communication device 1. A feed point 141 of the radiating metal portion 14 is electrically coupled to a signal source 15 disposed on the substrate 12.

Please note that, in this embodiment, the open slot 13 is substantially rectangle-shaped, but it is not meant to be a limitation of the present invention. In addition, the radiating metal portion 14 may be a monopole strip antenna, but the present invention is not limited to this.

Figure 2A:
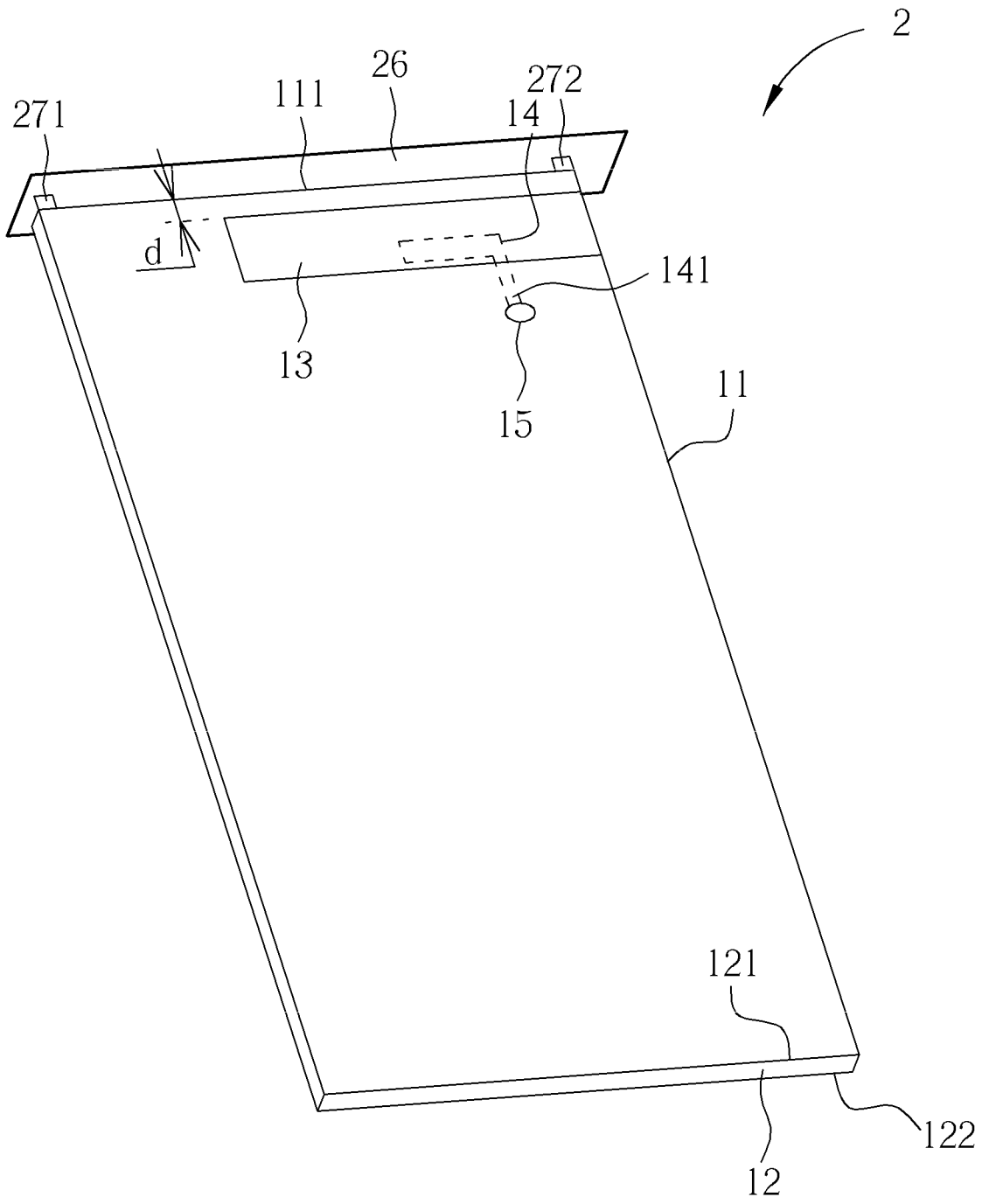
FIG. 2A is a structure diagram illustrating a communication device and its antenna structure according to a second embodiment of the present invention.
Figure 2B:
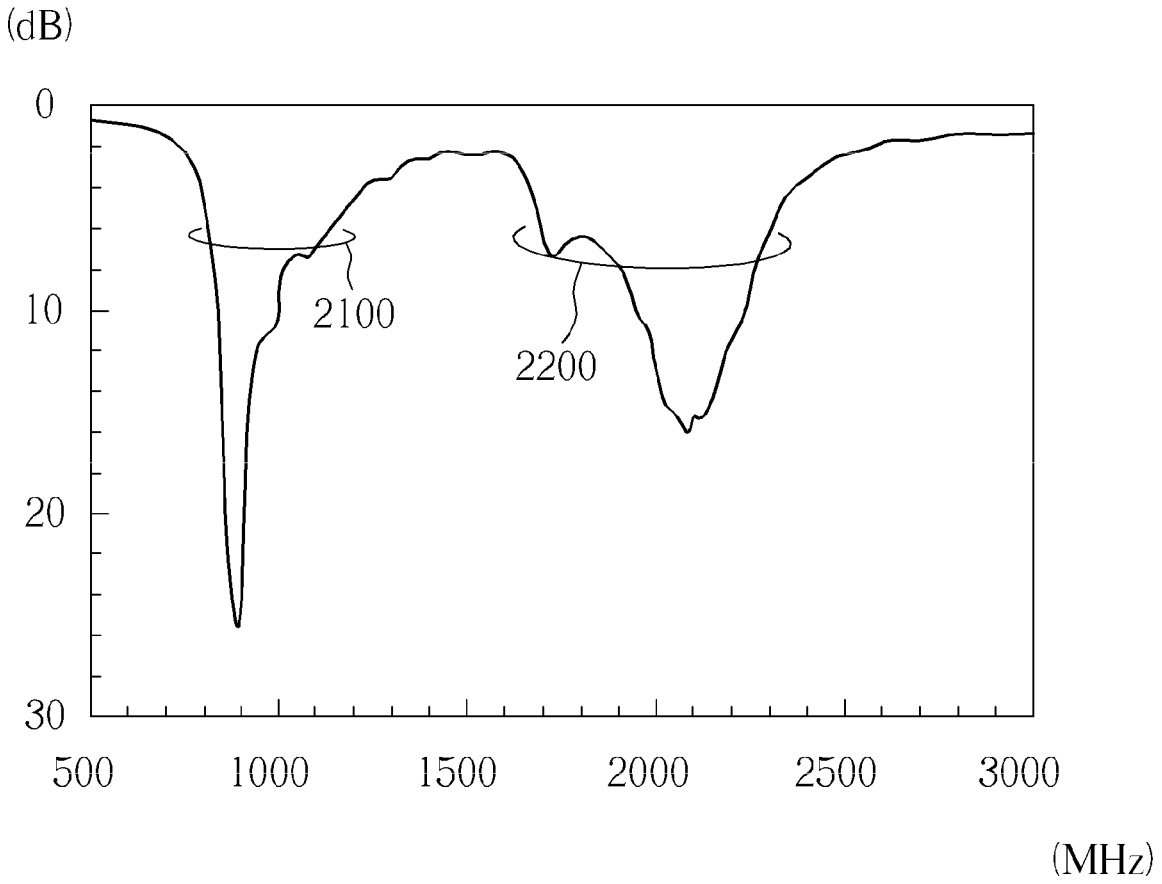
FIG. 2B is a diagram illustrating the return loss of the communication device and its antenna structure.

Please concurrently refer to FIG. 2A and FIG. 2B. FIG. 2A is a schematic diagram illustrating a communication device 2 and its antenna structure according to a second embodiment of the present invention, and FIG. 2B is a schematic diagram illustrating the return loss of the communication device 2 and its antenna structure. The main difference between the second embodiment and the first embodiment is that the communication device 2 and its antenna structure in FIG. 2A further includes a metal conductor 26, and the edge 111 of the ground element 11 is electrically coupled to the metal conductor 26 via a coupling point 271 and a coupling point 272. The metal conductor 26 is substantially perpendicular to the ground element 11, and has a width not larger than a thickness of the communication device 2. In this embodiment, the metal conductor 26 may be a part of a housing of the communication device 2, but it is not meant to a limitation of the present invention. Due to the fact that the antenna structure of the communication device 2 in the second embodiment is similar to the antenna structure of the communication device 1 in the first embodiment, the second embodiment may also have functions similar to that of the first embodiment.

Please note that, in the second embodiment, the following specifications may be chosen for an implementation: the length of the substrate 12 is about 110 mm, the width of the substrate 12 is about 60 mm, and the thickness of the substrate 12 is about 0.8 mm; the ground element 11 is formed on the substrate 12; the length of the open slot 13 is about 40 mm, and the width of the open slot 13 is about 9 mm. Due to the open slot 13 being printed on the substrate 12 which is a dielectric substrate, the length of the open slot 13 is about 0.12 wavelength of the center frequency (about 890 MHz) of first operating band 2100, and thus the length of the open slot 13 is shorter than a quarter wavelength of the center frequency. As shown in FIG. 2B, as may be known from a measurement result, the second embodiment of the present invention operates under the 6-dB return loss (widely used design specification for a mobile communication device antenna), the first operating band 2100 may cover about 824-960 MHz for the GSM850/900 operation, the second operating band 2200 may cover about 1710-2170 MHz for the GSM1800/1900/UMTS operation, and thus the antenna structure may cover the penta-band WWAN operation.

Figure 3A:
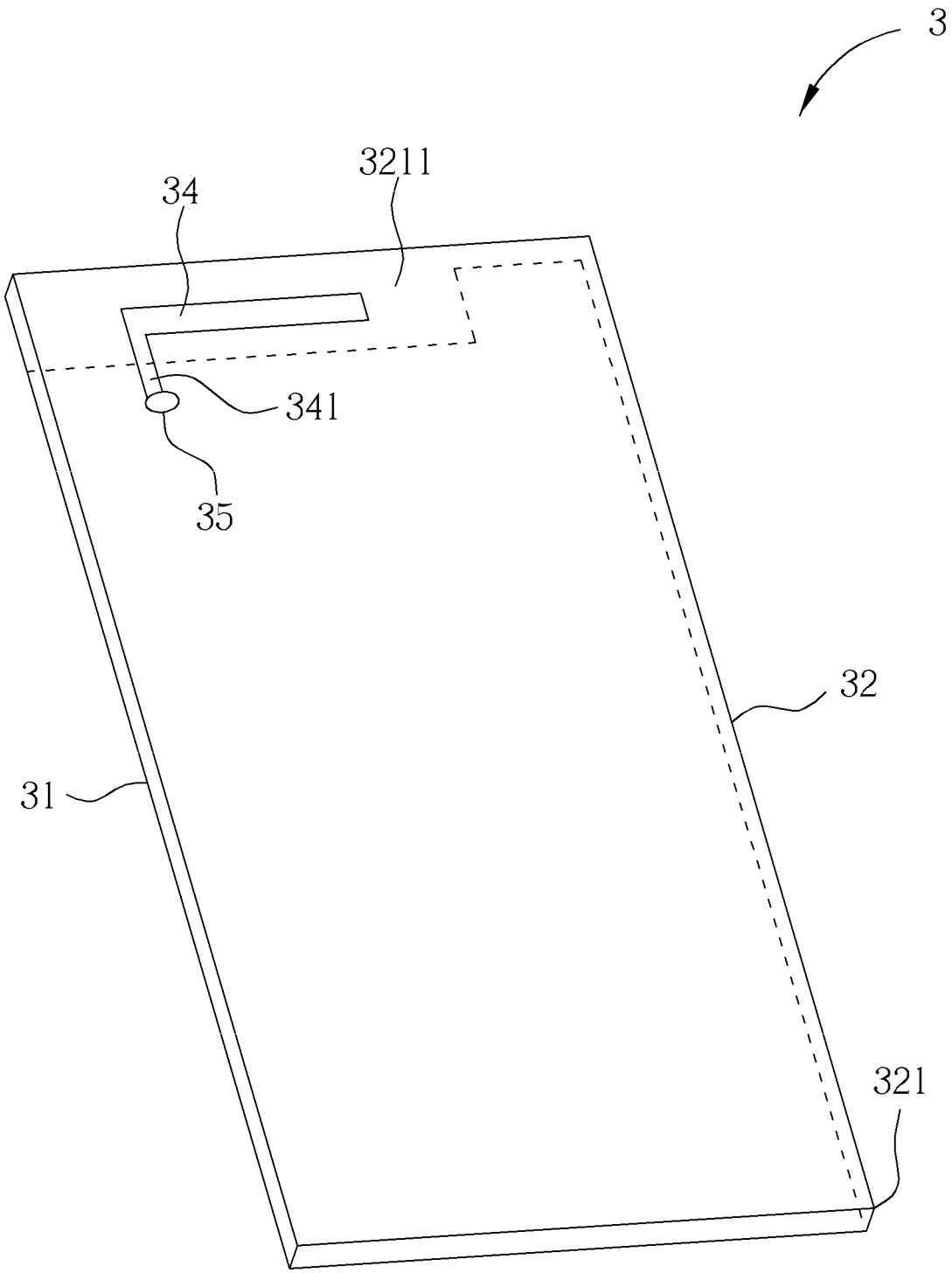
FIG. 3A PRIOR ART
FIG. 3A is a schematic diagram illustrating a communication device and its conventional antenna structure according to the prior art.
Figure 3B:
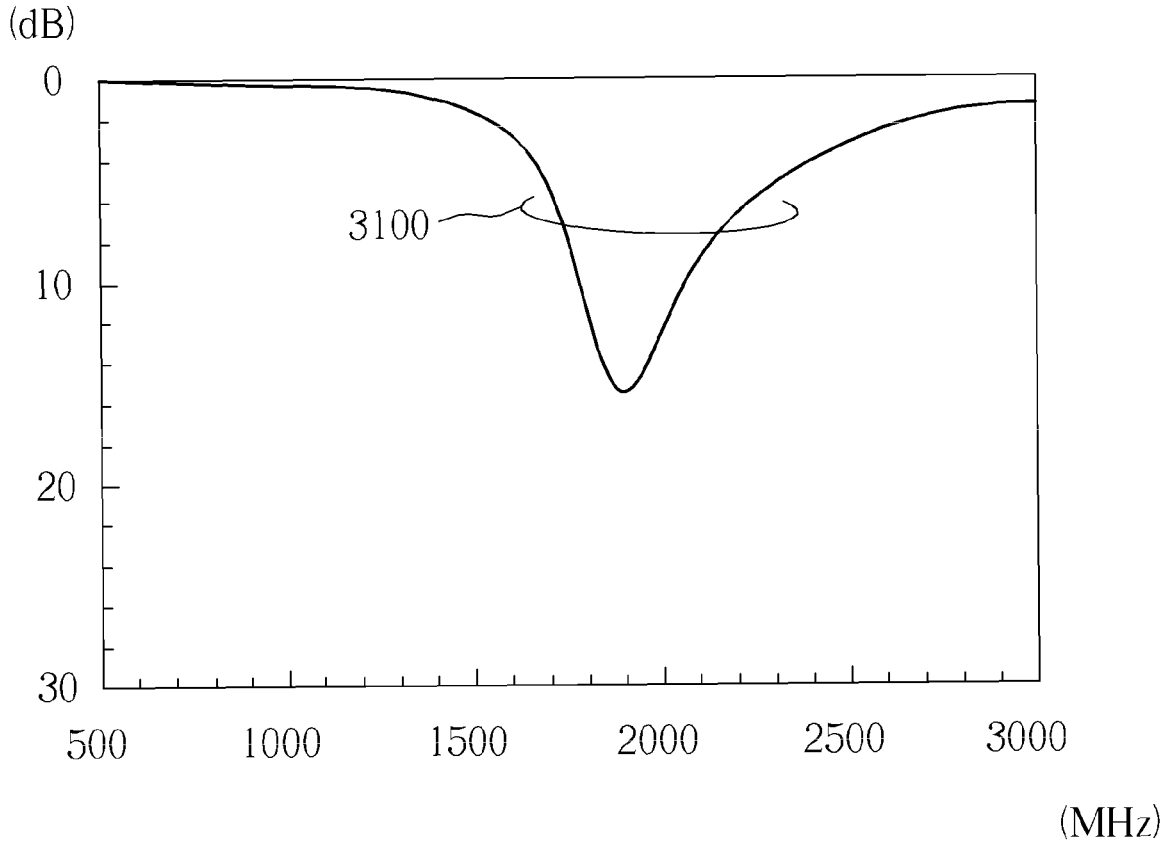
FIG. 3B PRIOR ART
FIG. 3B is a schematic diagram illustrating a simulation of return loss of communication device and its conventional antenna structure.

Please concurrently refer to FIG. 3A and FIG. 3B. FIG. 3A is a schematic diagram illustrating a communication device 3 and its conventional antenna structure according to the prior art, and FIG. 3B is a schematic diagram illustrating a simulation of return loss of communication device 3 and its conventional antenna structure. As shown in FIG. 3A, the communication device 3 includes a ground element 31, a substrate 32, and a radiating metal portion 34. The ground element 31 is disposed on a first surface 321 of the substrate 32. The radiating metal portion 34 is disposed in a clearance region 3211 on the substrate 32, and a feed point 341 of the radiating metal portion 34 is electrically coupled to a signal source 35 disposed on the substrate 32. It should be noted that, the difference between the communication device 3 and its conventional antenna structure and the communication device 1 and its antenna structure in the first embodiment of the present invention is that the communication device 3 and its conventional antenna structure only generate the resonant mode from the radiating metal portion 34, and fail to exploit the clearance region 3211 to form the open slot so as to increase the operating bandwidth.

Please note that, the following specifications may be chosen to conduct the simulation of the communication device 3 and its conventional antenna structure: the length of the substrate 32 is about 110 mm, the width of the substrate 32 is about 60 mm, the thickness of the substrate 32 is about 0.8 mm; the ground element 31 is formed on the substrate 32; and the length of the radiating metal portion 34 is about 34 mm. As shown in FIG. 3B, as may be known from a simulation result, the communication device 3 and its conventional antenna structure operate under 6-dB return-loss definition, the operating band 3100 thereof may only cover the GSM1800/1900/UMTS operation, when compared to the second embodiment of the present invention as shown in FIG. 2B. The conventional antenna structure fails to generate a resonant mode in the desired low-frequency band, and is therefore unable to cover the penta-band WWAN operation.

Figure 4:
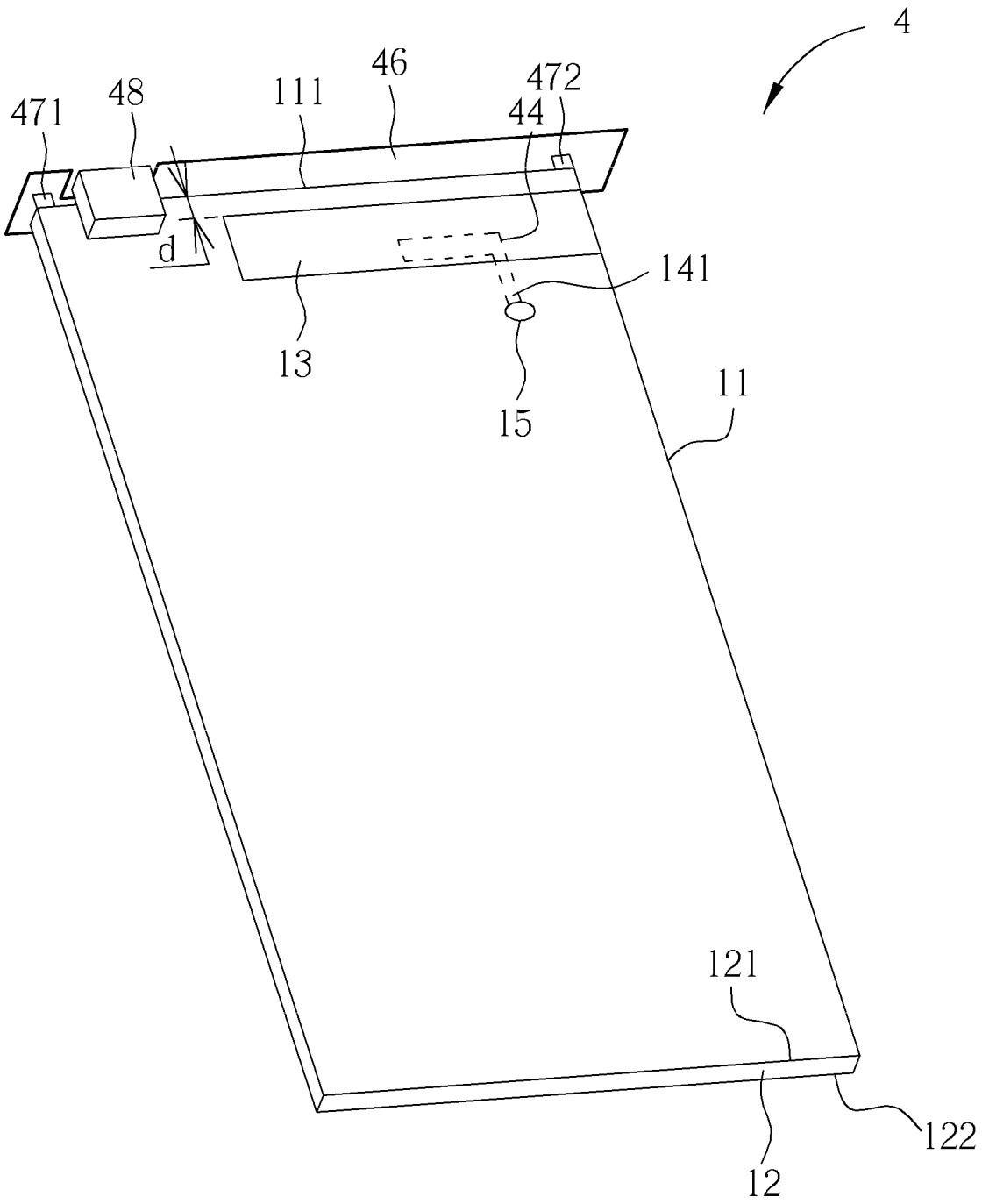
FIG. 4 is a structure diagram illustrating a communication device and its antenna structure according to a third embodiment of the present invention.

Please refer to FIG. 4, which is a structure diagram illustrating a communication device 4 and its antenna structure according to a third embodiment of the present invention. The main difference between the antenna structure of the third embodiment and the antenna structure the first embodiment is that, the edge 111 of the ground element 11 of the communication device 4 and its antenna structure in FIG. 4 is electrically coupled to a metal conductor 46 via a coupling point 471 and a coupling point 472. The metal conductor 46 has a width, and is substantially perpendicular to the ground element 11. The width of the metal conductor 46 is shorter than the thickness of the communication device 4. In this embodiment, the metal conductor 46 can integrate with an electronic element 48 such as a data transmission adapter or a USB (universal serial bus) connector, and part of the structure of the electronic element 48 is electrically coupled to the ground element 11. Due to the fact that the antenna structure of the third embodiment is similar to the antenna structure of the first embodiment, the third embodiment may also have functions similar to that of the first embodiment.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A communication device, comprising an antenna structure, the antenna structure comprising:

a substrate;

a ground element, disposed on a first surface of the substrate;

an open slot, formed on the ground element and parallel with an edge of the ground element, wherein the open slot at least generates a first resonant mode, and a distance between the open slot and the edge of the ground element is between 0 and 0.05 free-space wavelength of a resonant frequency of the first resonant mode;

a radiating metal portion, disposed on a second surface of the substrate, wherein the open slot at least partially covers the radiating metal portion, the radiating metal portion at least generates a second resonant mode, and a feed point of the radiating metal portion is electrically coupled to a signal source on the substrate; and a metal conductor, electrically coupled to the edge of the ground element and perpendicular to the ground element, wherein the metal conductor has a width which is not larger than a thickness of the communication device; the metal conductor is part of a housing of the communication device, and the metal conductor is a planar conductor, and the metal conductor extends along two opposite sides of the ground element.

2. The communication device of claim 1, wherein a first operating band corresponding to the first resonant mode covers a frequency range between 824-960 MHz, and a second operating band corresponding to the second resonant mode covers a frequency range between 1710-2170 MHz.

3. The communication device of claim 1, wherein the open slot is rectangle-shaped.

4. The communication device of claim 1, wherein the radiating metal portion is a monopole strip antenna.

5. The communication device of claim 1, wherein the metal conductor integrates with an electronic element, and part of a structure of the electronic element is electrically coupled to the ground element.

6. An antenna structure, comprising:

a substrate;

a ground element, disposed on a first surface of the substrate;

an open slot, formed on the ground element and parallel with an edge of the ground element, wherein the open slot at least generates a first resonant mode, and a distance between the open slot and the edge of the ground element is between 0 and 0.05 free-space wavelength of a resonant frequency of the first resonant mode;

a radiating metal portion, disposed on a second surface of the substrate, wherein the open slot at least partially covers the radiating metal portion, the radiating metal portion at least generates a second resonant mode, and a feed point of the radiating metal portion is electrically coupled to a signal source on the substrate; and a metal conductor, electrically coupled to the edge of the ground element and perpendicular to the ground element, wherein the metal conductor has a width which is not larger than a thickness of a communication device that the antenna structure is disposed in; the metal conductor is part of a housing of the communication device, and the metal conductor is a planar conductor, and the metal conductor extends along two opposite sides of the ground element.

7. The antenna structure of claim 6, wherein a first operating band corresponding to the first resonant mode covers a frequency range between 824-960 MHz, and a second operating band corresponding to the second resonant mode covers a frequency range between 1710-2170 MHz.

8. The antenna structure of claim 6, wherein the open slot is rectangle-shaped.

9. The antenna structure of claim 6, wherein the radiating metal portion is a monopole strip antenna.

* * * * *